US006743157B2

(12) United States Patent
Hackaday

(10) Patent No.: US 6,743,157 B2
(45) Date of Patent: Jun. 1, 2004

(54) BOXING AND MARTIAL ARTS TRAINING DEVICE

(76) Inventor: Robert Hackaday, 211 W. Heath St., Long Beach, CA (US) 90805

( * ) Notice: Subject to any disclaimer, the term of this patent is extended or adjusted under 35 U.S.C. 154(b) by 182 days.

(21) Appl. No.: 10/034,514

(22) Filed: Jan. 3, 2002

(65) Prior Publication Data

US 2003/0125168 A1 Jul. 3, 2003

(51) Int. Cl.[7] ..... A63B 21/00
(52) U.S. Cl. ..... 482/83; 482/89; 482/90
(58) Field of Search ..... 482/121–129; D21/692, 691; 114/219, 220, 218, 148

(56) References Cited

U.S. PATENT DOCUMENTS

| | | | | |
|---|---|---|---|---|
| 264,931 | A | | 9/1882 | Cook |
| 318,766 | A | | 5/1885 | Longden |
| 426,944 | A | | 4/1890 | Lovatt |
| 770,869 | A | | 9/1904 | Roe |
| 1,685,495 | A | | 9/1928 | Latz |
| 3,785,643 | A | | 1/1974 | Rich |
| D287,099 | S | | 12/1986 | Cory |
| 4,749,185 | A | | 6/1988 | Spears |
| 5,700,229 | A | | 12/1997 | Karnofsky |
| 5,720,700 | A | * | 2/1998 | Buoni et al. |
| 5,741,207 | A | * | 4/1998 | Buoni et al. |
| 6,244,998 | B1 | * | 6/2001 | Hinds |
| 6,494,157 | B1 | * | 12/2002 | Leemon |

* cited by examiner

*Primary Examiner*—Jerome W. Donnelly
(74) *Attorney, Agent, or Firm*—Charles H. Thomas

(57) ABSTRACT

A boxing training target is formed with a central, elongated, elastic bungee cord at its core. The elastic, bungee cord core line is encompassed within a plastic sheath that is surrounded by a resilient foam jacket having an outer diameter of between about one-half and six inches. The jacket extends over a length of at least about five feet of the core line in an area corresponding to the vertical level of the head, torso, and legs of an opponent. A sheath surrounds the jacket and has indicia thereon at different vertical levels. The elastic bungee cord is maintained in tension between an overhead support and a floor support. As blows are delivered to the target, the target quivers laterally thus necessitating good hand and eye coordination to repeatedly land blows upon the target. The vertically separated indicia provide different target areas for a boxer to vary the vertical level at which successive blows are delivered.

17 Claims, 3 Drawing Sheets

BOXING AND MARTIAL ARTS TRAINING DEVICE

BACKGROUND OF THE INVENTION

1. Field of the Invention

The present invention relates to a training device or apparatus useful for improving the pugilistic skills of a boxer or the skills of practitioners of other martial arts.

2. Description of the Prior Art

For many years boxers have utilized punching bags and large stuffed, punching dummies as targets to improve their boxing skills. A typical, conventional punching bag has a generally pear-shaped configuration and is formed of a leather cover having an inflated rubber bladder therewithin. A conventional punching bag is about one foot in length and typically hangs from an overhead omnidirectional swivel. A punching bag is advantageous because it improves eye and hand coordination for repeated punches at the same target area. However, it does not train a boxer to improve hand and eye coordination in making rapid vertical shifts in the target area.

A punching dummy allows a boxer to vary the target area of successive punches vertically, but does little to enhance hand and eye coordination.

Various devices have been created as training aids to improve the skills of boxers and other athletes. Some of these are described in the following issued U.S. Pat. Nos. 1,685,495; 770,869; 4,749,185; 264,931; 5,700,229; 426, 944; 318,766; and 3,785,643. However, none of these prior devices is particularly effective in improving a boxer's skills in making repeated, accurate punches while rapidly vertically shifting the target area for successive punches.

SUMMARY OF THE INVENTION

The present invention is a device that can be used by boxers and martial arts enthusiasts for training purposes. The training device is designed to be mounted between a stationary overhead support and a base support located vertically beneath in the floor of a training area. The device may be between about five and ten feet in length. At its upper end it has a snap ring or some other catch or fastener mechanism to engage a ceiling fastener and an inextensible strap of adjustable length with an adjustment buckle or Velcro fasteners that allow the effective length of the strap to be adjusted between a few inches or as much as several feet.

The lower end of the strap terminates in a loop or eye or some other catch or coupling mechanism that may be engaged with the end of a very long bungee cord. The bungee cord may be five or more feet in length and has a coupling at its upper end to engage the adjustment strap and a coupling at its lower end to engage a floor fastener. The bungee cord is surrounded by vinyl tubing having an outer diameter of about five-eighths of an inch. Surrounding the vinyl tubing there is a cylindrical, annular sleeve of resilient foam having an outer diameter of about between about one-half and three inches. The outer surface of the foam is preferably covered with tape or some other sheath material. Also, visual indicia are marked on the outside of the sheath. This indicia may merely take the form of changes in color about every three, four, or five inches along the length of the sheath.

The resulting structure appears to an observer as a relatively thick, rope-like device having bands of different colors every few inches. A person practicing boxing or a person practicing some other form of the martial arts may utilize his or her fists or feet to jab at the different colored sections of the elongated structure. The device will yield each time is struck, but will quickly return generally to its original, upright position after each blow. Due to the resiliency of the bungee cord, the structure will waver and quiver somewhat, thus making it harder to strike each time it receives an impact. The adjustable strap can be utilized to alter the tension on the bungee cord, thus varying the extent to which the device quivers laterally. This challenges the user to maintain consistent, repeated contact with blows to the device and improves the hand-eye coordination and provides excellent training for pugilistic and martial arts endeavors.

It is an object of the present invention to provide an improved training device, useful to boxers and other individuals involved in the martial arts, that sharpens the skills of applying impacts to a relatively small target, while making vertical shifts in applying successive blows to the target.

It is a further object of the invention to provide a boxing training device from which a boxer can tell, through tactile sensation, or lack of tactile sensation, whether or not successive blows have been accurately applied to a target while vertically shifting the target area in successive blows.

A further object of the invention is to provide a boxing target which does not wildly gyrate when struck, but which does quiver laterally and in a fore and aft direction when impacted, and thereby presents a challenging target to a boxer to successfully land successive blows on the target.

Still another object of the invention is to provide a boxing training device that is extremely effective in improving eye and hand coordination in landing successive blows on a target that quivers about a vertical axis of alignment when the target has been struck.

An additional object of the invention is to provide a boxing target that can be stored within a relatively small volume and which can be erected for use in many different locations. For example, the target of the invention does not necessarily require the availability of the gymnasium or other facility dedicated to athletic training. The boxing target of the invention may be temporarily erected in a doorway, in a garage, or in innumerable other locations that are used for other purposes at other times.

In one broad aspect the present invention may be described as a martial arts training apparatus comprising: an elongated core line no less than about five feet in length having opposing upper and lower ends and at least a portion of which is formed of an elastic material; upper and lower couplings located respectively at the upper and lower ends of the core line for securement, respectively, to upper and lower vertically separated supports to stretch the core line therebetween; and a resilient jacket located between the couplings and surrounding the core line over a distance of at least about five feet, wherein the jacket has a minimum outer width of between about one inch-half and about six inches.

In another broad aspect the invention may be considered to be a self-defense training apparatus comprising: an elongated core line at least about five feet in length and having opposing upper and lower ends, wherein at least a portion of the core line is formed of an elastic material; upper and lower couplings respectively located at the upper and lower ends of the core line for connection, respectively, to vertically spaced upper and lower stationary supports between which the core line is maintained in tension; and an elongated, resilient jacket surrounding the core line over a length of at least five feet and having an outer dimension measured transverse to the core line of between about one-half and about six inches.

In still another aspect the invention may be considered to be a boxing training target comprising: an elongated core line, at least about five feet in length and at least a portion of which is elastic, having opposing upper and lower ends; an upper coupling at the upper end of the core line for securement to a stationary, overhead support; a lower coupling at the lower end of the core line for securement to a stationary base support to maintain tension on the core line between the upper and lower couplings; and an annular, resilient jacket disposed about the core line and surrounding it throughout a length of at least about five feet, wherein the jacket has an outer diameter of between about one-half and about six inches.

The invention may be described with greater clarity and particularity by reference to the accompanying drawings.

DESCRIPTION OF THE EMBODIMENT

Figure 1:
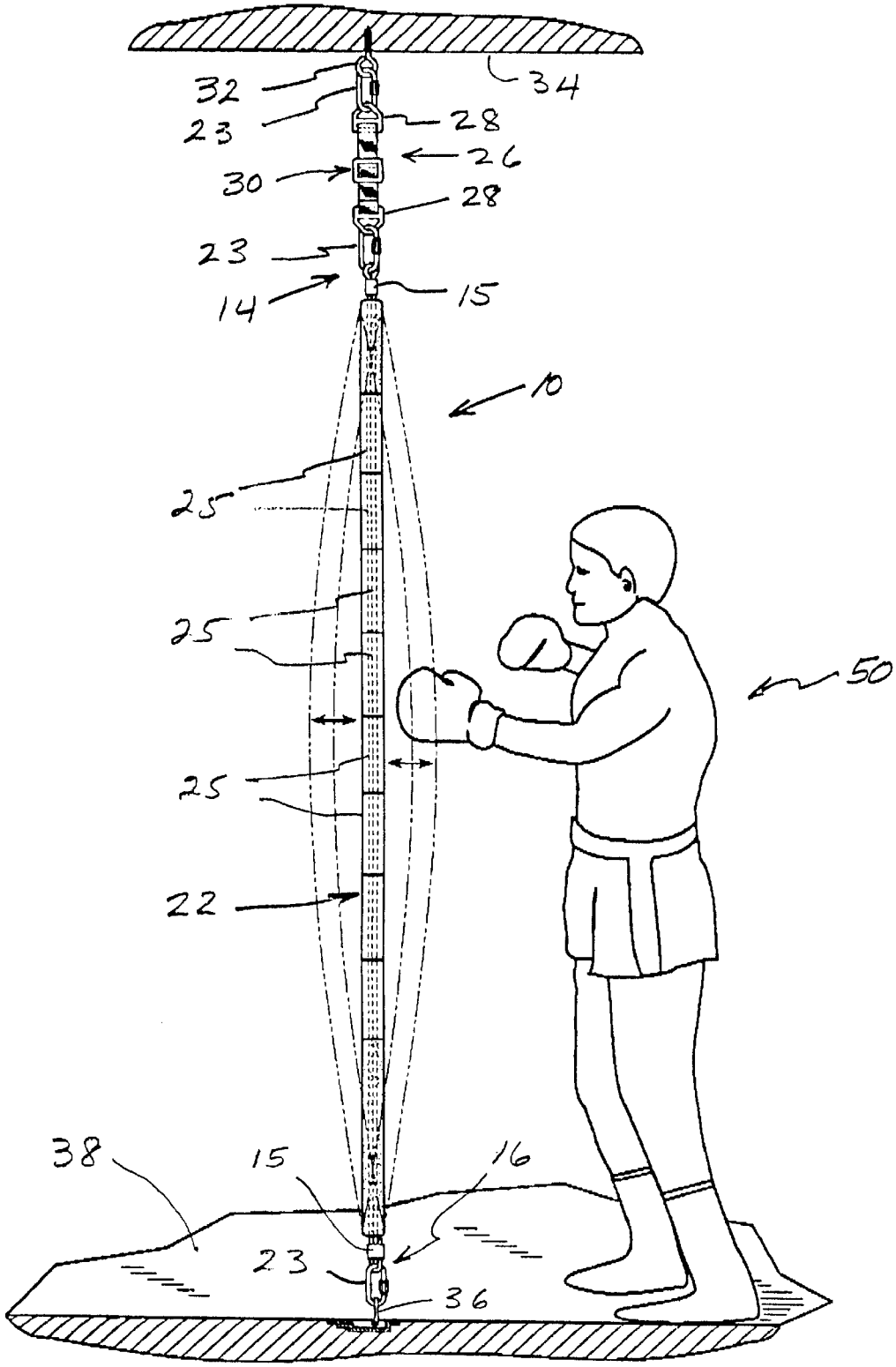
FIG. 1 is a perspective view illustrating a preferred embodiment and use of the boxing and martial arts target of the invention.

FIG. 1 illustrates a device 10 that can be used as a boxing target or a target for other martial arts and self-defense maneuvers. The boxing target 10 is comprised of an elongated core line 12, which is preferably a bungee cord, no less than about five feet in length and having opposing upper and lower ends. At least a portion of the core line 12 must be formed of an inelastic material. In the embodiment illustrated, the entire core line is a single, elongated, elastic bungee cord doubled back upon itself so as to have a double thickness throughout the length of the core line 12.

The boxing target 10 has an upper coupling 14 located at the upper end of the bungee cord 12, and a lower coupling 16 located at the lower end of the bungee cord 12. Both the upper and lower couplings 14 and 16 include a loop formed in the bungee cord 12 which is doubled back and clamped with a clamp 15. The bungee cord loop of the upper coupling 14 is passed through a releaseable coupling link 23, which is passed through the eye of a strap end termination link 28. The bungee cord loop of the lower coupling 16 also is passed through a releaseable coupling link 23 and clamped with a clamp 15. The couplings 14 and 16 allow the bungee cord core line 12 to be connected to upper and lower vertically separated supports to stretch the bungee cord core line 12 therebetween.

Figure 3:
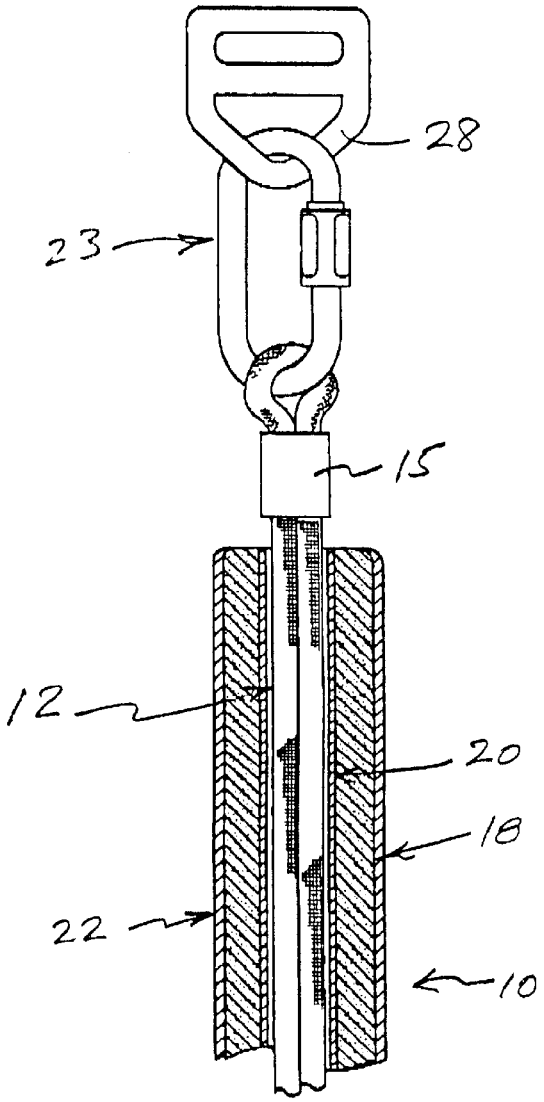
FIG. 3 is a sectional elevational detail of a portion of the boxing target shown in FIG. 1.
Figure 4:
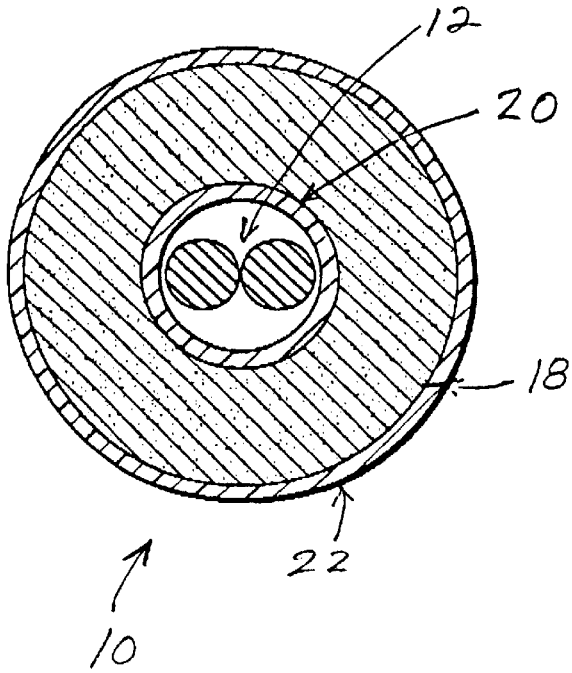
FIG. 4 is a transverse, sectional detail taken along the lines 4—4 in FIG. 2.

The boxing target 10 also includes a resilient jacket 18, visible in FIGS. 3 and 4, which preferably is formed of flexible, polyurethane foam or rubber. The resilient jacket 18 is located between the couplings 14 and 16 and surrounds the core line 12 over a distance of at least about five feet. More specifically, the core line 12 must be surrounded by the jacket 18 so that the jacket 18 resides at a vertical level corresponding to the head, torso, and leg area of an opponent when the boxing target 10 is fastened between vertically separated overhead and floor supports.

In the embodiment of the boxing target 10 illustrated, the core line 12 is shown as being about eight feet in length and is surrounded by the resilient jacket 18 throughout its entire length. The jacket 18 has an annular cross section and a minimum outer width of between about one-half inch and about six inches. In the preferred embodiment of the invention shown, the jacket 18 is between about one and a half and three inches in outer diameter, and preferably is about two and a half inches in diameter.

The boxing target 10 is further comprised of a tubular sleeve 20 interposed between the jacket 18 and the core line 12. The tubular sleeve 20 is a length of flexible, but somewhat stiff, vinyl tubing having an outer diameter of about five-eighths of an inch and an inner diameter of about one-half of an inch. The bungee cord 12 fits loosely enough within the surrounding sleeve 20 that it can stretch and retract freely therewithin.

The resilient foam jacket 18 is surrounded by a tubular, outer sheath 22. The sheath 22 may, for example, be formed by windings of tape of different colors that by their demarcations in color form a series of vertical bands 25 throughout the length of the sheath 22. Alternatively, the sheath 22 may be formed as a single, elongated, flexible tube having vertically spaced indicia thereon, such as colored bands, to define vertical demarcations along the upright length of the boxing target 10.

To provide a means for height adjustment the boxing target 10 is provided with an inelastic extension line in the form of an adjustable strap 26. The adjustable strap 26 has strap end termination links 28 at both of its ends and a length adjustment buckle 30 between its ends. The lower strap end termination link 28 of the adjustment strap 26 is engaged with a releaseable coupling link 23, which in turn is engaged with the bungee cord loop at the upper coupling 14 at the upper end of the bungee cord core line 12. The upper strap end termination link 28 of the adjustment strap 26 is engaged with an overhead support of some type. In FIG. 1 the overhead support is in the form of an eye loop 32 screwed into the ceiling 34. A releaseable fastener in the form of a releaseable coupling link 23 is utilized to link the upper strap termination link 28 to the ceiling eye loop 32. The lower coupling 16 at the lower end of the bungee cord core line 12 is connected to an eye ring 36 that is secured in the floor 38. Gymnasiums and exercise facilities are often equipped with eye rings of this type hinged into their floors.

Once the boxing target 10 has been mounted in a vertical orientation between the overhead support, namely between the ceiling loop 32 and the floor ring 36, the adjustment buckle 30 of the adjustment strap 26 is either tightened or loosened to place the bungee cord core line 12 under the appropriate tensile force suitable for the boxer using the target 10. The adjustment buckle 30 may be cinched tighter to prevent the target 10 from sagging loosely and loosened somewhat so that the bungee cord line 12 of the target 10 will exhibit a laterally quivering movement upon receipt of a blow.

The boxer then proceeds to practice punching and jabbing blows at the target 10 varying the height of the intended impact as between the different color demarcations defined by the different colored bands 25. When the boxer connects with a punch, the boxing target 10 will exhibit a quivering movement from side to side and forward and backward. This quivering movement presents a challenge to the boxer to continue to deliver blows with accuracy. Practice with the boxing target 10 improves a boxer's hand an eye coordination, since the laterally quivering target is difficult to hit accurately if the resilient jacket 18 has a narrow diameter.

The boxing target 10 can be manufactured in different sizes for use by boxers having different skill levels. For example, a beginning pugilist may practice upon a boxing target 10 in which the resilient foam jacket 18 has an outer diameter which may be as large as about six inches. Such a target is not particularly difficult to hit with accuracy, even delivering successive blows at different vertical levels. However, for boxers having greater skill, a boxing target 10 of a smaller outer diameter, for example about two and a half inches, may prove much more challenging.

Figure 2:
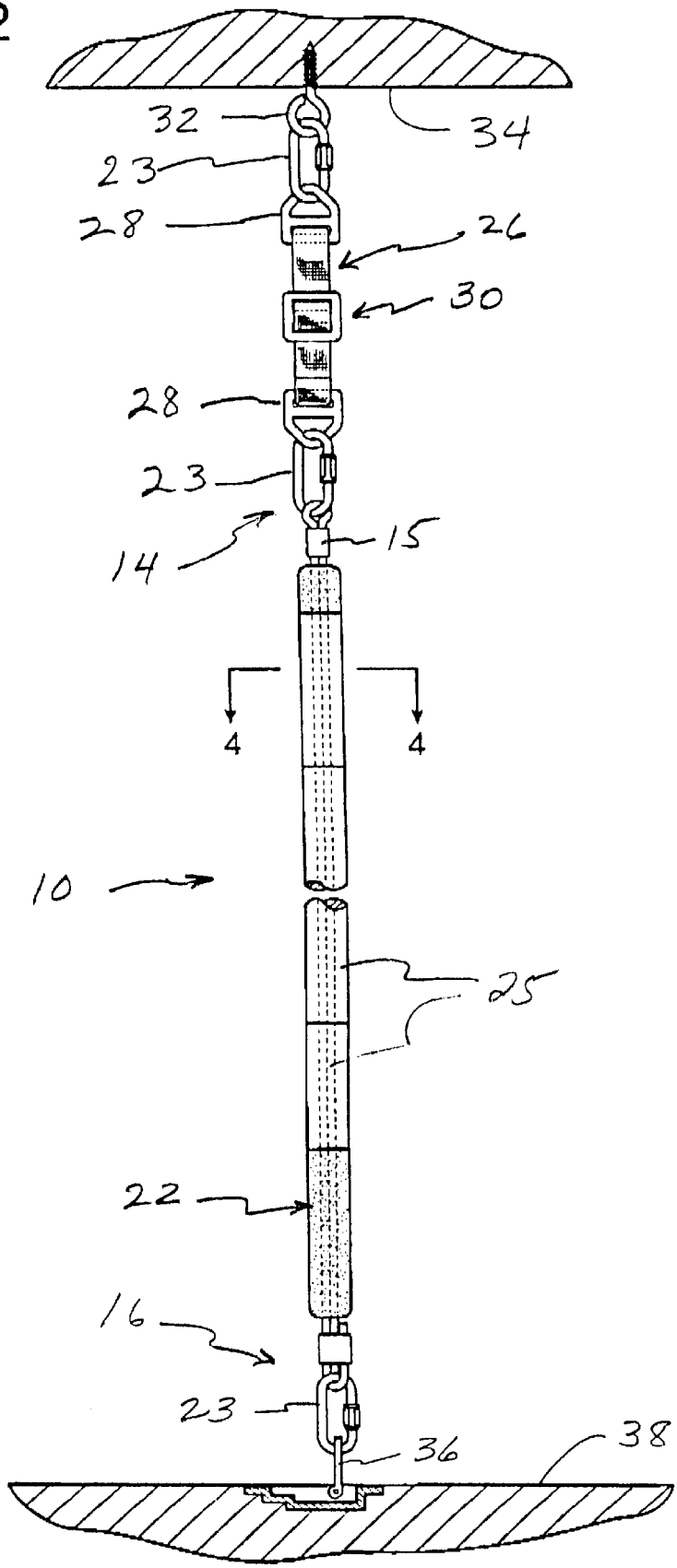
FIG. 2 is an elevational view of the target shown in FIG. 1 illustrated in greater detail.

To utilize the boxing target 10 the upper coupling link 23 at the upper end of the adjusting strap 26 is engaged with the ceiling loop 32 and the lower coupling link 23 is engaged with the floor ring 36, as illustrated in FIG. 2. The adjusting buckle 30 is then manipulated to lengthen or shorten the trailing tail 29 of the adjustable strap 26, which lengthens or shortens the distance between the two adjustment strap termination links 28. The effective length of the adjustable strap 26 is adjusted until a suitable amount of tension is placed upon the bungee cord core line 12 so that the boxing target 10 will vibrate and quiver both laterally and in a fore and aft direction when blows are delivered to it by a boxer 50, as illustrated in FIG. 1.

The boxer 50 then practices his boxing skills by repeatedly striking the target 10 and varying the vertical level of the blows delivered to it from one colored band 25 to the next up and down the central portion of the boxing target 10. The boxer 50 can tell by the resistance felt by his hands in delivering each blow as to whether or not he has successfully struck the target 10. The quivering motion of the central portion of the target 10 forces the boxer 50 to develop good hand and eye coordination so that the boxer 50 becomes better able to accurately deliver punches to a small, moving target area. Furthermore, the different colored bands 25 provided different target areas at different vertical elevations. The boxer 50 is thereby able to improve his skills in varying the vertical level of delivery of successive punching blows.

It should be noted that the utility of the training device 10 is not limited to boxing. Indeed, it is useful for any martial arts discipline in which blows are delivered to a target, including karate, taekwondo, and other disciplines of the martial arts in which blows are delivered to a target by either the hands or the feet of an athlete.

Undoubtedly, numerous variations and modifications of the invention will become readily apparent to those familiar with boxing and martial arts training devices. For example, different types of releaseable snap-hooks, catches, fasteners, couplings, and connections may be substituted for the releaseable coupling links 23 and for the couplings 14 and 16. Accordingly, the scope of the invention should not be construed as limited to the specific embodiment depicted and described, but rather is defined in the claims appended hereto.

I claim:

1. A martial arts training apparatus comprising:

an elongated core line no less than about five feet in length having opposing upper and lower ends, and at least a portion of which is formed of an elastic material, upper and lower couplings located respectively at said upper and lower ends of said core line for securement, respectively, to upper and lower vertically separated supports to stretch said core line therebetween, a resilient jacket located between said couplings and surrounding said core line over a distance of at least about five feet, wherein said jacket has a maximum outer width of between about one-half inch and about six inches, and a tubular sleeve interposed between said jacket and said core line.

2. A martial arts training apparatus according to claim 1 wherein said core line is formed as an elongated bungee cord and is elastic throughout its entire length.

3. A martial arts training apparatus according to claim 2 further comprising an inelastic extension line connected to at least one of said couplings, and said extension line is adjustable in length.

4. A martial arts training apparatus according to claim 1 wherein said jacket is formed of a resilient foam material.

5. A martial arts training apparatus according to claim 1 further comprising demarcation indicia spaced longitudinally along said jacket to denote different vertical levels.

6. A martial arts training apparatus according to claim 5 further comprising a flexible sheath surrounding said jacket, and said demarcation indicia are formed on said sheath.

7. A martial arts training apparatus according to claim 1 wherein said jacket has a maximum outer width of no greater than about three inches.

8. A self-defense training apparatus according to claim 7 wherein said core line is comprised of a bungee cord.

9. A self-defense training apparatus according to claim 7 further comprised of releaseable fasteners joined to said upper and lower ends of said core line.

10. A self-defense training apparatus comprising:

an elongated core line at least about five feet in length and having opposing upper and lower ends, and at least a portion of said core line is formed of an elastic material, upper and lower couplings respectively located at said upper and lower ends of said core line for connection, respectively, to vertically spaced upper and lower stationary supports between which said core line is maintained in tension, an elongated, resilient jacket surrounding said core line over a length of at least about five feet and having an outer dimension measured transverse to said core line of between about one-half and about six inches, and an elongated plastic sleeve located about said core line, and said jacket is disposed upon the exterior of said plastic sleeve.

11. A self-defense training apparatus according to claim 10 wherein said jacket is comprised of a resilient foam material.

12. A self-defense training apparatus comprising:

an elongated core line at least about five feet in length and having opposing upper and lower ends, and at least a portion of said core line is formed of an elastic material, upper and lower couplings respectively located at said upper and lower ends of said core line for connection, respectively, to vertically spaced upper and lower stationary supports between which said core line is maintained in tension, an elongated, resilient jacket surrounding said core line over a length of at least about five feet and having an outer dimension measured transverse to said core line of between about one-half and about six inches, and an elongated sheath surrounding said jacket and having longitudinally spaced indicia thereon.

13. A self-defense training apparatus comprising:

an elongated core line at least about five feet in length and having opposing upper and lower ends, and at least a portion of said core line is formed of an elastic material, upper and lower couplings respectively located at said upper and lower ends of said core line for connection, respectively, to vertically spaced upper and lower stationary supports between which said core line is maintained in tension, an elongated, resilient jacket surrounding said core line over a length of at least about five feet and having an outer dimension measured transverse to said core line of between about one-half and about six inches, and an inelastic extension of adjustable length connected to at least one of said couplings.

14. A boxing training target comprising:

an elongated core line, at least about five feet in length and at least a portion of which is elastic, having opposing upper and lower ends, an upper coupling at said upper end of said core line to permit securement of said core line to a stationary, overhead support, a lower coupling at said lower end of said core line to permit securement of said core line to a stationary base support to maintain tension on said core line between said upper and lower couplings, an annular, resilient jacket disposed about said core line and surrounding it throughout a length of at least about five feet, wherein said jacket has an outer diameter of between about one-half and about six inches, and wherein said core line is comprised of a bungee cord and further comprising a tubular sleeve disposed about said bungee cord and within the confines of said jacket.

15. A boxing training target according to claim 14 further comprising an extension line of adjustable length connected to at least one of said ends of said core line.

16. A boxing training target according to claim 14 wherein said jacket has a maximum outer dimension transverse to said core line of no greater than about three inches.

17. A boxing training target comprising:

an elongated core line, at least about five feet in length and at least a portion of which is elastic, having opposing upper and lower ends, an upper coupling at said upper end of said core line to permit securement of said core line to a stationary, overhead support, a lower coupling at said lower end of said core line to permit securement of said core line to a stationary base support to maintain tension on said core line between said upper and lower couplings, an annular, resilient jacket disposed about said core line and surrounding it throughout a length of at least about five feet, wherein said jacket has an outer diameter transverse to said core line of between about one-half and about three inches, and a sheath disposed about said jacket and bearing indicia that divide said sheath into a plurality of bands located vertically one above another.

* * * * *